US006712034B2

(12) United States Patent
Fischer

(10) Patent No.: US 6,712,034 B2
(45) Date of Patent: Mar. 30, 2004

(54) ARRANGEMENT FOR THE DETACHABLE FIXING OF AN INLET DEVICE TO THE CYLINDER HEAD

(75) Inventor: Peter Fischer, Nittendorf (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/458,100

(22) Filed: Jun. 10, 2003

(65) Prior Publication Data

US 2003/0213457 A1 Nov. 20, 2003

Related U.S. Application Data

(63) Continuation of application No. PCT/DE01/04645, filed on Dec. 10, 2001.

(30) Foreign Application Priority Data

Dec. 12, 2000 (DE) ..... 10061706

(51) Int. Cl.[7] ..... F02B 75/08
(52) U.S. Cl. ..... 123/193.5
(58) Field of Search ..... 123/193.5, 193.1, 123/193.3

(56) References Cited

U.S. PATENT DOCUMENTS

| | | | | |
|---|---|---|---|---|
| 5,025,763 A | * | 6/1991 | Watanabe | 123/198 E |
| 5,295,602 A | | 3/1994 | Swanson | |
| 5,967,116 A | | 10/1999 | Kawashima et al. | |
| 6,062,200 A | * | 5/2000 | Hofmeister | 123/470 |
| 6,299,661 B1 | * | 10/2001 | Bloomer | 55/385.3 |
| 6,354,260 B1 | * | 3/2002 | Newsom et al. | 123/193.5 |
| 6,526,933 B2 | * | 3/2003 | Iizuka et al. | 123/193.5 |

FOREIGN PATENT DOCUMENTS

| | | |
|---|---|---|
| DE | 3632013 A1 | 4/1987 |
| DE | 39 11 153 A1 | 10/1990 |
| DE | 40 35 016 A1 | 5/1991 |
| DE | 196 47 184 A1 | 5/1998 |
| DE | 198 12 844 A1 | 1/1999 |

* cited by examiner

*Primary Examiner*—Marguerite McMahon
(74) *Attorney, Agent, or Firm*—Baker Botts L.L.P.

(57) ABSTRACT

An arrangement for the detachable fixing of an inlet device to the cylinder head of an internal combustion engine (6) wherein the inlet device (6) is fixed to the cylinder head (2) by means of a locking mechanism (10), which permits a simple assembly without the need for separate connector elements.

19 Claims, 1 Drawing Sheet

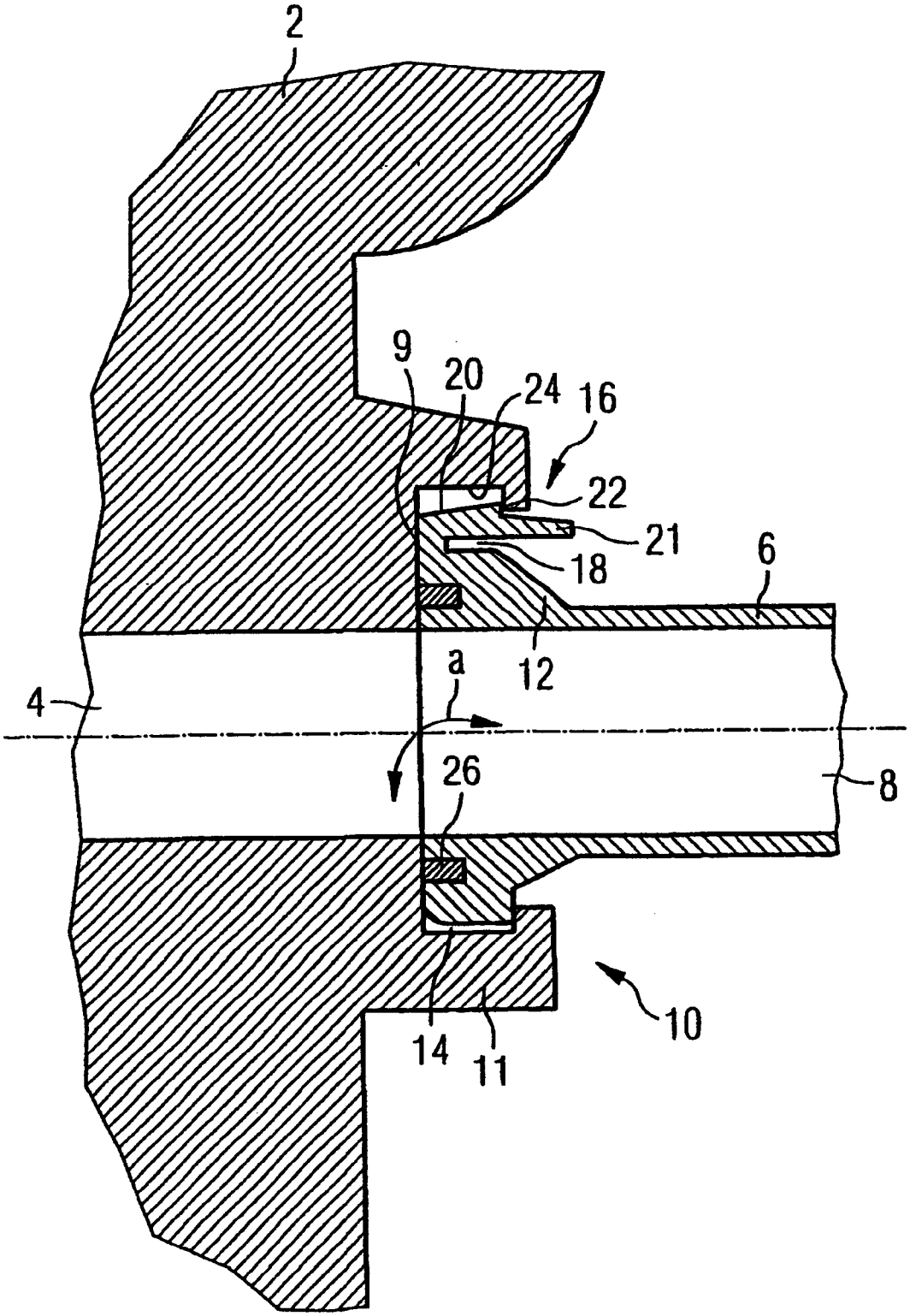
2
9
20
24
16
22
21
18
6
12
a
4
26
8
10
14
11

ARRANGEMENT FOR THE DETACHABLE FIXING OF AN INLET DEVICE TO THE CYLINDER HEAD

CROSS REFERENCE TO RELATED APPLICATION

This application is a continuation of copending International Application No. PCT/DE01/04645 filed Dec. 10, 2001, which designates the United States.

TECHNICAL FIELD OF THE INVENTION

The present invention relates to an arrangement for the detachable fixing of an inlet device to the cylinder head of an internal combustion engine by means of a locking mechanism which is integrated at least in a flange intrinsic to the cylinder head.

BACKGROUND OF THE INVENTION

Such an arrangement is known from DE 40 35 016 A1. The inlet device there has a connecting end made of a rubber-elastic material, said connecting end being slipped over the flange of the cylinder head. However, since this is a loose connection which is not sealed and does not hold when the engine is running, in the known arrangement a clamping ring made of a relatively rigid material is pushed over the connecting end, the inner diameter of the clamping ring having a lower value than the outer diameter of the connecting end, with the result that this procedure requires a certain amount of skill and expenditure of force as well as a certain amount of time. In addition, while this fixing method is possibly well suited for a hand-operated tool, since the cylinder head flange is easily accessible there, the method is not satisfactory for applying under the confined conditions in the engine compartment of a motor vehicle. Furthermore, two fixing steps, for which moreover two hands are needed, have to be carried out in the known method.

A locking mechanism is disclosed in DE 196 47 184 A1, wherein a rotating movement of a clamp spring is executed in order to fix an air inlet tube in a housing section, but the housing section itself is connected by means of a conventional screw connection to the cylinder head of an internal combustion engine.

The detachable connection of such inlet devices to the cylinder head by means of connector elements such as screws, threaded bolts or spring clips, as described in DE 196 47 184 A1, is the customary connecting method. The design, manufacture and assembly of such connector elements entail a corresponding outlay. In addition, the accessibility of the fixing elements presents a substantial problem, particularly in the case of complex inlet devices.

SUMMARY OF THE INVENTION

The object of the present invention is to create an arrangement for the detachable fixing of an inlet device to the cylinder head of an internal combustion engine, said arrangement being as simple as possible to assemble and eliminating the problem of the accessibility of connector elements.

To achieve this object, the invention provides that in an arrangement of this type the locking mechanism, which is also integrated in a flange of the inlet device, can be snapped in by a rotating movement of the inlet device relative to the cylinder head.

In one embodiment an arrangement for the detachable fixing of an inlet device to the cylinder head of an internal combustion engine comprises means of a locking mechanism which is integrated at least into one intrinsic flange of the cylinder head, wherein the locking mechanism, also integrated into a flange of the inlet device, can be snapped in through a rotating movement of the inlet device relative to the cylinder head.

The flange of the inlet device can be inserted on one side into an appropriately sized undercut clamping notch of the cylinder head and can be secured on the opposite side by a snap-in notch/spring connection on the cylinder head. The snap-in notch/spring connection may consist of a sprung section formed on the inlet device and an undercut snap-in notch formed on the cylinder head, into which snap-in notch the sprung section with a shoulder molded thereon can be snapped in. A ramp can be molded on the sprung section, said ramp providing for the deflection of the sprung section, said deflection being necessary in order for the locking mechanism to snap in. The sprung section may have a projecting actuating end for detaching the snap-in notch/spring connection. Between adjacent faces of the cylinder head and of the inlet device an elastic seal may be located, and said seal may pre-bias the locking mechanism into a state free from play.

Another embodiment is an arrangement for the detachable fixing of an inlet device to the cylinder head of an internal combustion engine wherein the inlet device can be fixed to the cylinder head by means of a locking mechanism, the locking mechanism is integrated into a flange of the inlet device and into an intrinsic flange of the cylinder head, the locking mechanism can be snapped in by means of a rotating movement of the inlet device relative to the cylinder head, and the flange of the inlet device can on one side be inserted into an appropriately sized undercut clamping notch of the cylinder head and on the opposite side be secured by a snap-in notch/spring connection to the cylinder head.

Yet another embodiment is an arrangement for the detachable fixing of an inlet device to the cylinder head of an internal combustion engine comprising a locking mechanism operable to fix the inlet device to the cylinder head, wherein the locking mechanism is integrated into a flange of the inlet device and into an intrinsic flange of the cylinder head, the locking mechanism comprises snap-in means operable to snap in by a rotating movement of the inlet device relative to the cylinder head, the cylinder head comprises an undercut clamping notch, and further comprising a snap-in notch/spring connection.

The snap-in notch/spring connection may consist of a sprung section formed on the inlet device and an undercut snap-in notch formed on the cylinder head, into which snap-in notch the sprung section with a shoulder molded thereon can be snapped in. A ramp can be molded on the sprung section, said ramp providing for the deflection of the sprung section, said deflection being necessary in order for the locking mechanism to snap in. The sprung section may have a projecting actuating end for detaching the snap-in notch/spring connection. Between adjacent faces of the cylinder head and of the inlet device an elastic seal may be located, and said seal may pre-bias the locking mechanism into a state free from play.

Consequently, no separate connector elements are required in the solution according to the invention. This gives rise to an extremely simple assembly, since, in order to attach and detach the inlet device, no connector elements have to be tightened or loosened. Furthermore, since the problem of accessibility in relation to connector elements does not arise, there is increased freedom of design in respect of the suction device.

BRIEF DESCRIPTION OF THE DRAWING

An exemplary embodiment of the invention is described in detail by reference to the single FIGURE, which shows a longitudinal section through an arrangement, fashioned according to the invention, for the detachable fixing of an inlet device to the cylinder head of an internal combustion engine.

DETAILED DESCRIPTION OF THE PREFERRED EMBODIMENTS

FIG. 1 shows a section of a cylinder head 2 with an inlet channel 4 to which an inlet device 6 with a corresponding inlet channel 8 must be attached such that their plane faces 9 butt against one another and the inlet channels 4, 8 are in alignment with one another. It is understood that the cylinder head 2 and the inlet device 6 are, depending on the number of cylinders, each provided with multiple inlet channels which are arranged behind one another in a direction perpendicular to the drawing plane.

The inlet device 6 is detachably fixed to the cylinder head 2 by means of a locking mechanism 10. The locking mechanism 10 is integrated in a flange 11 of the cylinder head 2 and a flange 12 of the inlet device 6, as described in detail below.

The flange 11 of the cylinder head 2 is furnished on its side shown lowermost in the figure, with an undercut clamping notch 14, into which the flange 12 of the inlet device can be inserted. The flange 12 of the inlet device 6 is dimensioned in its lower side, as shown in the figure, such that it fits with minimal play into the clamping notch 14.

On the side shown uppermost in the figure, the inlet device 6 is secured by a snap-in notch/spring connection to the cylinder head 2. The snap-in notch/spring connection has, provided on the flange 12 of the inlet device 6, a sprung section 16 which is formed by a slot 18 which, on the side facing away from the faces 9, is worked into the flange 12. The sprung section 16 has a ramp 20 starting from the associated face 9, said ramp being separated from an adjoining actuating end 21 by a shoulder 22. The flange 11 of the cylinder head 2 is furnished on the side shown uppermost in the figure with a snap-in notch 24 into which the sprung section 16 can snap with its shoulder 22 in order to secure the inlet device 6 to the cylinder head 2, as described in detail below.

To attach the inlet device 6 to the cylinder head 2, the inlet device 6 is first inserted at the appropriate inclination with its flange 12 entering the clamping notch 14. In order to simplify the insertion of the flange 12 into the clamping notch 14, the flange 14 is furnished adjacent to the face 9 with a chamfer, as indicated in the figure. The inlet device 6 is then rotated upward by means of a rotating movement about an axis running perpendicular to the drawing plane (see arrow a), thereby causing the snap-in notch/spring connection to snap in. Put more precisely, the ramp section 20 first slides along the outside edge of the upper section of the flange 12, as a result of which the sprung section 16 is elastically deflected until the sprung section 16 snaps in with its shoulder 22 into the snap-in notch 24.

As shown in the figure, the inlet device 6 is furnished on its face which faces toward the cylinder head 2 with a seal 26. The seal 26 fulfills a dual purpose: firstly, it seals off the inlet channels 4,8 from the surroundings; secondly, it generates a contact pressure which elastically pre-biases the locking mechanism 10 so that the locking mechanism is protected against vibrations and jerking movements.

To detach the inlet device 6 from the cylinder head 2, the sprung section 16 is detached from its lock with the snap-in notch 24 by pressure on the projecting actuation end 21, whereupon the inlet device 6 can be rotated in the opposite direction. The flange 12 of the inlet device 6 can then be detached from the clamping notch 14.

As far as usable materials are concerned, the cylinder head 2 can be made as usual of aluminium and the inlet device 6 of a plastic such as polyamide. The seal is composed of an elastic material such as e.g. a media-stable and temperature-stable elastomer. It is understood, however, that other materials can also be used as long as the function of the parts concerned continues to be ensured.

The arrangement described can be used with any internal combustion engines such as those e.g. of the spark-ignition or compression-ignition type. It should otherwise be noted that the design shown represents only one possible embodiment of a locking mechanism. In principle, any possible locking mechanism which functions without separate connector elements can be used.

What is claimed is:

1. An arrangement for the detachable fixing of an inlet device to the cylinder head of an internal combustion engine by means of a locking mechanism which is integrated at least into one intrinsic flange of the cylinder head, wherein the locking mechanism, also integrated into a flange of the inlet device, can be snapped in through a rotating movement of the inlet device relative to the cylinder head.

2. An arrangement according to claim 1, wherein the flange of the inlet device can be inserted on one side into an appropriately sized undercut clamping notch of the cylinder head and can be secured on the opposite side by a snap-in notch/spring connection on the cylinder head.

3. An arrangement according to claim 2, wherein the snap-in notch/spring connection consists of a sprung section formed on the inlet device and an undercut snap-in notch formed on the cylinder head, into which snap-in notch the sprung section with a shoulder molded thereon can be snapped in.

4. An arrangement according to claim 3, wherein a ramp is molded on the sprung section, said ramp providing for the deflection of the sprung section, said deflection being necessary in order for the locking mechanism to snap in.

5. An arrangement according to claim 2, wherein the sprung section has a projecting actuating end for detaching the snap-in notch/spring connection.

6. An arrangement according to claim 3, wherein the sprung section has a projecting actuating end for detaching the snap-in notch/spring connection.

7. An arrangement according to claim 1, wherein between adjacent faces of the cylinder head and of the inlet device an elastic seal is located, and wherein said seal pre-biasing the locking mechanism into a state free from play.

8. An arrangement for the detachable fixing of an inlet device to the cylinder head of an internal combustion engine wherein the inlet device can be fixed to the cylinder head by means of a locking mechanism, the locking mechanism is integrated into a flange of the inlet device and into an intrinsic flange of the cylinder head, the locking mechanism can be snapped in by means of a rotating movement of the inlet device relative to the cylinder head, and the flange of the inlet device can on one side be inserted into an appropriately sized undercut clamping notch of the cylinder head and on the opposite side be secured by a snap-in notch/spring connection to the cylinder head.

9. An arrangement according to claim 8, wherein the snap-in notch/spring connection consists of a sprung section formed on the inlet device and an undercut snap-in notch formed on the cylinder head, into which snap-in notch the sprung section with a shoulder molded thereon can be snapped in.

10. An arrangement according to claim 9, wherein a ramp is molded on the sprung section, said ramp providing for the deflection of the sprung section, said deflection being necessary in order for the locking mechanism to snap in.

11. An arrangement according to claim 8, wherein the sprung section has a projecting actuating end for detaching the snap-in notch/spring connection.

12. An arrangement according to claim 9, wherein the sprung section has a projecting actuating end for detaching the snap-in notch/spring connection.

13. An arrangement according to claim 8, wherein between adjacent faces of the cylinder head and of the inlet device an elastic seal is located, and wherein said seal pre-biasing the locking mechanism into a state free from play.

14. An arrangement for the detachable fixing of an inlet device to the cylinder head of an internal combustion engine comprising:

a locking mechanism operable to fix the inlet device to the cylinder head, wherein the locking mechanism is integrated into a flange of the inlet device and into an intrinsic flange of the cylinder head, the locking mechanism comprises snap-in means operable to snap in by a rotating movement of the inlet device relative to the cylinder head, the cylinder head comprises an undercut clamping notch, and further comprising a snap-in notch/spring connection.

15. An arrangement according to claim 14, wherein the snap-in notch/spring connection consists of a sprung section formed on the inlet device and an undercut snap-in notch formed on the cylinder head, into which snap-in notch the sprung section with a shoulder molded thereon can be snapped in.

16. An arrangement according to claim 15, wherein a ramp is molded on the sprung section, said ramp providing for the deflection of the sprung section, said deflection being necessary in order for the locking mechanism to snap in.

17. An arrangement according to claim 14, wherein the sprung section has a projecting actuating end for detaching the snap-in notch/spring connection.

18. An arrangement according to claim 15, wherein the sprung section has a projecting actuating end for detaching the snap-in notch/spring connection.

19. An arrangement according to claim 14, wherein between adjacent faces of the cylinder head and of the inlet device an elastic seal is located, and wherein said seal pre-biasing the locking mechanism into a state free from play.

* * * * *